United States Patent [19]

Itoh et al.

[11] Patent Number: 4,684,448

[45] Date of Patent: Aug. 4, 1987

[54] PROCESS OF PRODUCING NEODYMIUM-IRON ALLOY

[75] Inventors: Katsuhisa Itoh; Yoshiaki Watanabe, both of Nagoya; Eiji Nakamura, Chita; Masayasu Toyoshima, Nagoya, all of Japan

[73] Assignee: Sumitomo Light Metal Industries, Ltd., Japan

[21] Appl. No.: 776,800

[22] Filed: Sep. 17, 1985

[30] Foreign Application Priority Data

Oct. 3, 1984 [JP] Japan ..... 59-207733
Nov. 22, 1984 [JP] Japan ..... 59-247546

[51] Int. Cl.[4] ..... C25C 3/36
[52] U.S. Cl. ..... 204/71
[58] Field of Search ..... 204/71, 245

[56] References Cited

U.S. PATENT DOCUMENTS 3,298,935 1/1967 Henrie et al. ..... 204/71
3,383,294 5/1968 Wood ..... 204/71
3,729,397 4/1973 Goldsmith et al. ..... 204/64 R
3,855,087 12/1974 Yamanaka-et al. ..... 204/71

FOREIGN PATENT DOCUMENTS 49-34412 3/1974 Japan ..... 204/71
59-46008 3/1984 Japan .

OTHER PUBLICATIONS

"Electrowinning Misch Metal . . . " by E. S. Shedd et al, U.S. Bur. Mines-R. I. 7398, 1970.
Electrodes. Eng., Mantell, 4th Ed. McGraw-Hill, 1960, pp. 359, 367-369.
Determ. of Oxide Solubility in Molten Fluorides, by Porter et al., U.S. Bur. of Mines R. I. 5878, 1961.
Al Electrolysis, K. Grjotheim et al., pp. 265-292.
"Prep. & Some Props. of Metallic Nd", Kremers, AES 47th Gen. Meeting; Trans. AES, vol. 47, 1925, pp. 365-371.
Preparation of Neodymium Metal by Fused Salt Electrolysis by J. Shiokawa, T. Kurita, T. Ishino—6 pages.
Electrowinning High-Purity Neodymium, Praseodymium, and Didymium Metals from their Oxides, by E. Morrice and T. A. Henrie, May 1967, (Bureau of Mines Investigates No. 6957).
Direct Electrolysis of Rare-Earth Oxides to Metals and Alloys in Fluoride Melts, by E. Morrice, E. S. Shedd and T. A. Henrie 1968 (Bureau of Mines-Report of Investigations, 7146).

*Primary Examiner*—R. L. Andrews
*Attorney, Agent, or Firm*—Parkhurst & Oliff

[57] ABSTRACT

A process and an apparatus for producing a neodymium-iron alloy by electrolysis reduction of neodymium fluoride in a bath of molten electrolyte, consisting essentially of 35-76% by weight of neodymium fluoride, 20-60% by weight of lithium fluoride, up to 40% by weight of barium fluoride and up to 20% by weight of calcium fluoride, conducted between one or more iron cathode and one or more carbon anode. The apparatus comprises an electrowinning cell of refractory materials coated inside with a lining resistive to the bath, the carbon anode of constant transverse cross-sectional shape over its length, immersed into the electrolyte bath at its free and, the iron cathode of constant transverse cross-sectional shape over its length, immersed into the electrolytic bath at its free end, a receiver placed on the bottom of the cell for collecting the produced neodymium-iron alloy in a liquid state on the tip of the iron cathode, siphoning means for withdrawing the molten alloy pooled in the receiver out of the cell, and feeding means for feeding the ever wearing iron cathode into the electrolyte bath so as to apply the direct current to the iron cathode with a predetermined current density.

5 Claims, 3 Drawing Figures

PROCESS OF PRODUCING NEODYMIUM-IRON ALLOY

BACKGROUND OF THE INVENTION

1. Field of the Invention

The present invention relates to a process of producing a neodymium-iron alloy and an apparatus for producing the same. More particularly it relates to a process of continuously producing or manufacturing a neodymium-iron alloy of high neodymium content, which can be advantageously used as a material for a high-quality permanent magnet and free from containing, for that use, harmful impurities and non-metallic inclusions.

2. Description of the Prior Art

Recently high-quality permanent magnets, made of rare earth and iron or rare earth, iron and boron, which do not contain expensive samarium and cobalt and which are also superior in the magnetic properties to the hard ferrite, have been drawing public attention. Above all, a permanent magnet consisting of neodymium, iron, and boron is generally recognized as an excellent material for a maximum energy product, (BH) max more than 36 MGOe, and also for its superiority in its weight-to-volume ratio and mechanical strength (a Japanese laid open patent application: TOKU-KAI-SHO-59 (1984)-46008 can be referred). In this type of permanent magnet, made of neodymium and iron or neodymium, iron, and boron, it is essentially required to obtain a material or materials containing least possible impurities which deteriorate magnetic properties, and to industrially establish a manufacturing process, particularly as to a neodymium material which is high in reactivity, of getting one containing a minimum of impurities, for example, oxygen, as possible.

Metallic neodymium has been, in fact, regarded almost useless, and the industrial manufacturing process of obtaining the same has not been settled, yet, except only for the method of reducing a neodymium compound by utilizing an active metal, especially calcium, and for that of electrolyzing the same in an electrowinning bath, i.e., a fused salt electrolyte. It can therefore be said that no industrial process is firmly established for producing a neodymium-iron alloy which is suitable for being used as a permanent magnet of the type mentioned above.

Processes, which can be named at the present level of the technology, of manufacturing the neodymium-iron alloy, under those circumstances, are described below. All of them, however, are not satisfactory, because of inherent disadvantages or problems, and practical limitations for containing industrial processes.

(a) A method wherein metallic neodymium is prepared beforehand by means of reducing a neodymium compound with an active metal such as calcium or by means of electrowinning the same in a bath of electrolyte, and the obtained metallic neodymium is melted together with iron for alloying them:

The method, however, is problematical in the first step of preparing the neodymium metal. The reduction method utilizing an active metal such as calcium belongs to a batch system, so to speak, which is not suited for a continuous operation in a large scale. In the electrowinning method, two techniques can be named as a prior art: Electrolysis in an electrolyte bath of fused chlorides (see Jiro Shiokawa et al. in "Denki Kagaku (Electrochemistry)" Vol. 35, pages 496 et seq. (1967), and others) and electrolysis of oxide ($Nd_2O_3$) dissolved in an electrolyte bath of fused fluorides (see E. Morrice et al., "U.S. Bur. of Min., Rep. of Invest.", No. 6957, 1967). All of them can not be an established method suitable for a continuous and large scale operation, still containing some defects and problems in their results of electrolysis and methods of operation.

(b) Another method wherein alloying is executed by means of reducing a mixture of a neodymium compound and an iron compound or iron by utilizing a reducing agent such as calcium:

This method can not be, either, an alternative the general reduction method carried out in a batch style, and is unsuitable for a continuous and large scale operation.

(c) Still another method wherein an alloy of neodymium and iron is deposited on so-called unconsumable cathode by simultaneous electrolytic reduction which is carried out in a bath of electrolyte dissolving both a neodymium compound and an iron compound therein:

This method is economically inferior even to the undermentioned method (d), because the composition of the alloy can not be kept constant or uniform, and the iron obtained is too expensive. Iron is obtainable in a large scale and less expensive in an ordinary method, not by this uneconomical process using the electrolysis of the fused salts.

(d) The so-called consumable cathode method, wherein the process of depositing the metallic neodymium on a consumable cathode of iron and the alloying process between the neodymium and the iron simultaneously occur in one electrolytic reduction step of the neodymium oxide ($Nd_2O_3$) as a neodymium compound, executed in a suitable bath of an electrolyte of fused salts.

As to this method an experimental study is disclosed by E. Morrice et al. in a publication of "U.S. Bur. of Min., Rep. of Invest.", No. 7146, 1968. This method, wherein electrolysis is executed in a bath of electrolyte of fused fluorides by adding neodymium oxide thereinto, is considered far superior to the above-introduced three methods, from (a) to (c), not being subject to faults inevitable to those prior art method. The method, however, is still not free from some inherent shortcomings from a technological viewpoint.

The shortcomings will be described in more detail: the solubility of the neodymium oxide in the selected electrolyte bath is as low as 2% in this method which uses the neodymium oxide as its raw material; moreover, the solubility tends to become lower, because the temperature of the electrolyte bath must be selected to be as low as practical for the purpose of obtaining an alloy with as little impurities as possible as stated in the object of the present invention, and the lower temperature of the bath makes the dissolution of the neodymium oxide more difficult. As a consequence, difficulty of continuous and stable supplying of the raw material to the bath will cause the undermentioned problems, which hinder the industrial application of this process where the continuous operation is essential.

(1) An abnormal phenomenon called "anode effect" occurs frequently due to shortage of the raw material dissolved in the electrolyte bath. The anode effect is well known to be specific to the electrolysis of the fused salts, particularly fluorides. (2) The undissolved raw material prevents liquid drops of the produced alloy from coalescing. (3) The undissolved raw material tends to be precipitated on the bottom of the electrolytic cell as sludge. The sludge subsequently degrades the formed alloy due to inclusion of undesirable foreign matter, deteriorates the utilization yield of the raw material, and disturbs the electrolysis operation. (4) Too much occurrence of the anode effect deteriorates the electrolysis results. And (5) the continuation of the electrolysis itself encounters sometimes difficulties of various sorts.

SUMMARY OF THE INVENTION

This invention was made from the above-mentioned background. The principal object of this invention is, therefore, to provide a process, which should be practicable continuously and in a large scale, for producing a neodymium-iron alloy, particularly a neodymium-iron alloy suitable for use in the manufacture of a permanent magnet of high performance, and an apparatus therefor. Another object of this invention is to provide an industrial manufacturing method of a neodymium-iron alloy with high content of neodymium and low content of impurities and non-metallic inclusions, and to provide an apparatus for industrially realizing the method, the method being reliable and economical.

To attain the above objects the present invention which aims to produce, a neodymium-iron alloy, wherein a neodymium compound is electrolytically reduced in a bath of molten electrolyte with at least one iron cathode and at least one carbon anode to electrodeposit neodymium on the at least one iron cathode and to alloy the electrodeposited neodymium with iron of the at least one iron cathode, wherein (a) neodymium fluoride is used as the neodymium compound, and the bath of electrolye containing the neodymium compound is so prepared as to consist essentially of 35–76% by weight of the neodymium fluoride, 20–60% by weight of lithium fluoride, 0–40% by weight of barium fluoride and 0–20% by weight of calcium fluoride; (b) the neodymium-iron alloy is produced in a liquid state on at least one iron cathode; (c) drops of the liquid neodymium-iron alloy from the at least one iron cathode gravitate to a bottom of the both and are collected in a receiver having a mouth which is open upward in a lower portion of the bath of electrolyte below the at least one iron cathode so as to be accumulated therein in the form of a molten pool; and (d) the liquid neodymium-iron alloy reserved in the form of a molten pool is siphoned or tapped in its liquid state from the receiver.

According to the present invention, a neodymium-iron alloy can be manufactured in only one step of electrolytic reduction. In this one step of electrolytic reduction, a neodymium-iron alloy of high content of neodymium, which is low in the content of impurities such as oxygen and inclusions adversely affecting the magnetic properties of the permanent magnet, can be manufactured with high efficiency. The invented method is additionally provided with various merits: use of a solid cathode allows easy handling of the same; siphoning the produced alloy in a liquid state in the course of the electrolysis or electrowinning makes it possible to continue the electrolysis sustantially without interruption, i.e., a continuous electrolysis operation is attainable; the advantage of the use of so-called consumable cathode is fully attainable, i.e., a continuous operation of the electrolysis under lower temperatures remakably improves the electrolysis results or yields and the grades of the produced alloys.

The method according to the present invention allows to enlarge the scale of the operation and to elongate the time duration of the operation which has been regarded impossible in the traditional reduction processes using an active metal such as calcium. It also allows to eliminate fundamental difficulties observed in the continuous operation of the electrolytic manufacturing method executed in a mixture of fused salts of fluoride and oxide which uses neodymium oxide as a raw material. Another merit of this method resides in the capability of maintaining high current efficiency for a relatively long period of time which can not be attained in the electrolysis of a chloride-containing electrolyte bath which uses neodymium chloride as a raw material.

It is preferable in the performance of this invented method to maintain the bath of electrolyte of fused salts at temperatures 770°–950° C. during the electrolysis operation; it is also preferable to set the anode current density at 0.05–0.60 A/cm$^2$ and the cathode current density at 0.50–55 A/cm$^2$ during the electrolytic reduction operation.

Another desirable condition for the electrolytic operation is to have the electrolyte bath containing the neodymium compound and consisting essentially of neodymium fluoride and lithium fluoride, the content of the former being at least 40% by weight and that of the latter at least 24% by weight in the electrolyte bath.

The invented method makes it possible to manufacture economically, continuously and in a large scale, the neodymium-iron alloy of high neodymium content which is suitable for use as a material for a high performance permanent magnet because of its low content of impurities. Such a neodymium-iron alloy can also be preferably used as an intermediate material for manufacturing pure neodymium metal.

For realizing the method according to this invention it is desirable to have an apparatus which comprises (a) an electrowinning cell constructed of refractory materials for charging a bath of electrolyte consisting essentially of neodymium fluoride and lithium fluoride, and optionally barium fluoride and/or calcium fluoride as needed; (b) a lining applied to the inner surface of the electrowinning cell and being contacted with the bath of electrolyte; (c) an elongate carbon anode or anodes, having a substantially constant transverse cross sectional shape over its length, for being inserted and immersed in the bath of electrolyte; (d) an elongate iron cathode or cathodes having a substantailly constant transverse cross sectional shape over its length for being inserted and immersed in the bath of electrolyte; (e) a receiver having a mouth which is open upward in a lower portion of the electrowinning cell below the free end portion of the iron cathode(s), for reserving a molten pool of the neodymium-iron alloy which is produced on the iron cathode(s), by means of electrolytic reduction of neodymium fluoride with a direct current applied between the carbon anode(s) and the iron cathode(s), and which drips off the iron cathode(s) thereinto; (f) a siphoning means for withdrawing the molten pool of the neodymium-iron alloy from the receiver out of the electrowinning cell; and (g) a positioning means for positioning the iron cathode(s) into the bath of electrolyte so as to apply the direct current to the iron cathode(s) with a predetermined current density, for compensating for a comsumed (wear) length of the iron cathode(s) during production of the neodymium-iron alloy.

It is further desirable in the neodymium iron alloy producing apparatus according to this invention to provide an ascent-and-descent means for positioning the carbon anode(s) into the electrolyte bath with a purpose of obtaining a predetermined current density, and a raw material-supply means for adding or supplying the neodymium fluoride as the material into the electrolyte bath. As the lining which is applied to the inner surface of the electrowinning cell, inexpensive iron material is preferably used in place of the refractory material such as molybdenum or tungsten which withstands the corrosive action of the bath. The inventors found in their experiments that the iron material has excellent corrosion resistance to the bath and that the iron can be preferably used as the lining material in the case of the electrolyte bath of fused fluorides.

In a preferred embodiment of the invention, the neodymium-iron alloy, reserved in a molten liquid state in the receiver disposed in the electrowinning cell, is withdrawn from the cell through the siphoning means for withdrawing the molten alloy with a pipe-like nozzle inserted thereinto. This siphoning of the molten alloy from the cell by means of vacuum suction undertaken through the nozzle is desirable from an industrial viewpoint.

According to another preferred embodiment of the apparatus of the invention, at least one of the iron cathode(s) is made of a pipe-like or tubular member of iron which is to be alloyed with the deposited neodymium by the electrolytic reduction. By employing such an elongate hollow pipe-like iron cathode, the design of anode-cathode-configuration becomes more flexible through advantageous continuation of the electrolytic reduction associated with an efficient consumption of the cathode and moderate prevention of an interpolar distance increase even in the case of employment of a plurality of large diameter anodes.

It is also possible to use advantageously the longitudinal hollow space within the pipe-like iron cathode(s) in different ways, such as making it perform as the raw material-supply means or making it function as a protection gas-passing route by connecting an upper opening of the cathode(s) to a protection gas-supplying means. The protection gas, blown therefrom under a positive pressure through the cathode(s) into the electrolyte bath, can stir the bath for enhancing the dissolution of the raw material and also can protect the inner surface of the cathode(s) from corrosion.

BRIEF DESCRIPTION OF THE DRAWINGS

These and other objects, and many of the attendant features and advantages of this invention will be readily appreciated, as the same becomes better understood by reference to the following detailed description of illustrative embodiments when considered in connection with the accompanying drawings, in which.

DETAILED DESCRIPTION OF THE PREFERRED EMBODIMENTS

To further clarify the present invention, illustrative embodiments of the invention will be described in detail with reference to the accompanying drawings.

Figure 1:
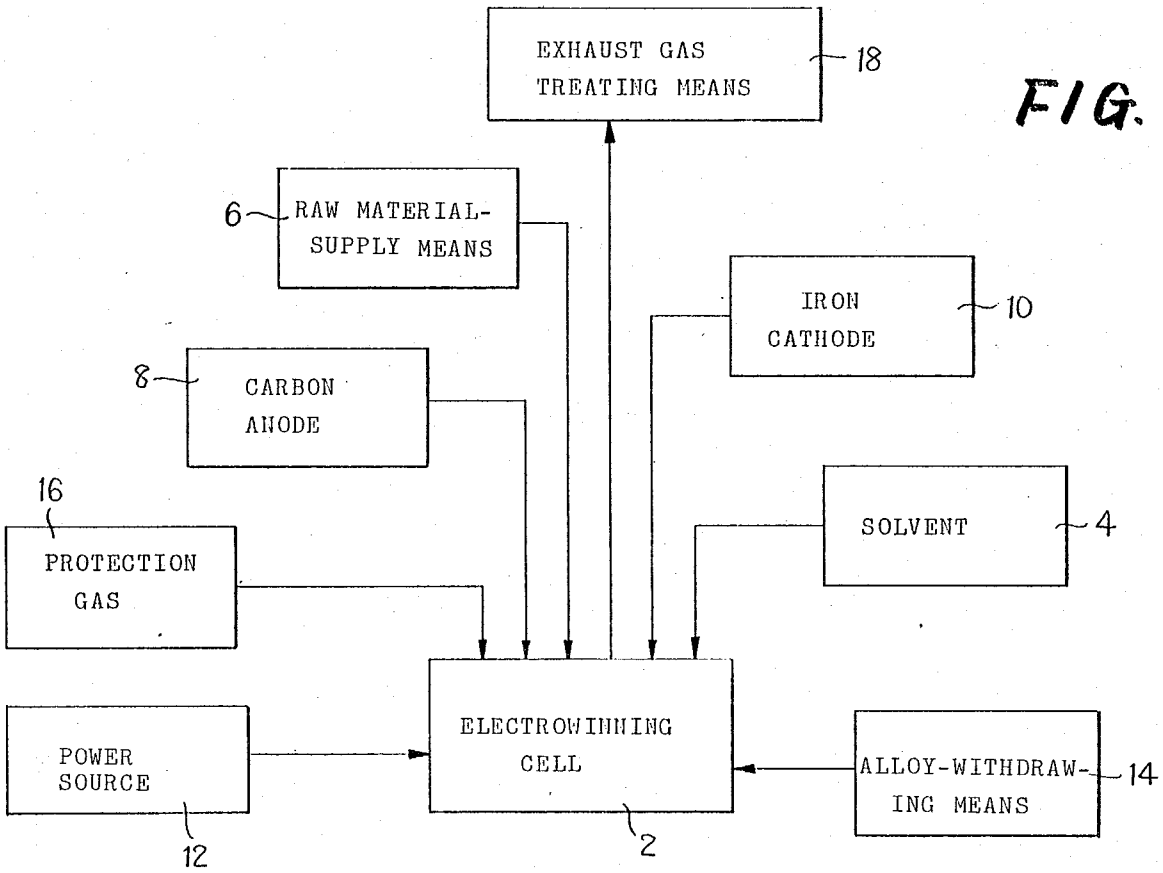
FIG. 1 is a schematic diagram of a concrete example of the electrolysis system for realizing the method according to this invention.

An electrowinning cell 2, which is a principal part of the electrolysis or electrowinning system illustrated in the schematic diagram of FIG. 1, is to contain in it a solvent 4 constituting an electrolyte bath or mixed molten salts. As the solvent 4, a mixture of neodymium fluoride ($NdF_3$) and lithium fluoride (LiF) are used; it is possible, however, to optionally add barium fluoride ($BaF_2$) and calcium fluoride ($CaF_2$), individually or simultaneously, as needed. The electrolysis raw material is supplied, on the other hand, from a raw material-supply means 6 into the electrolyte bath in the electrowinning cell 2. As the raw material, neodymium fluoride is specially used in this invention, in place of the traditional raw material, neodymium oxide, and the neodymium fluoride is at the same time one component of the electrolyte bath.

In the electrolyte bath contained in the electrowinning cell 2, a carbon anode or anodes 8 and an iron cathode or cathodes 10 are respectively inserted to be immersed therein. Between the anodes 8 and the cathodes 10 direct current is applied with a power source 12 so as to carry out electrolytic reduction of the raw material, neodymium fluoride. Metallic neodymium electrodeposited on the cathodes 10 will immediately produce an alloy, in a liquid state, together with the iron constituting the cathode 10. The liquid alloys produced on the cathodes 10 will drip one after another into a receiver placed in the electrolyte bath in the electrowinning cell 2 and will form a molten pool therein. Since the produced alloys on the cathodes 10 becomes liquid at the temperature where the electrolyte is fused, and specific gravity of the electrolyte bath is chosen smaller than those of the produced alloys, the liquid alloys drip readily one after another off of the surface of the each cathode 10, as it is formed thereon.

The liquid alloy, collected in this manner in the receiver which is located below the cathodes 10 and the mouth of which is open upward, is withdrawn from the electrowinning cell 2 with a suitable siphoning means, i.e., an alloy-withdrawing means 14 so as to be recovered.

Further, protection gas 16 such as Ar, He, $N_2$, etc. is introduced into the electrowinning cell 2 for the purpose of preventing the electrolyte bath, the produced alloy, the anodes 8 and the cathodes 10, and the structural materials of the cell from being deteriorated, and also to avoid the pickup of harmful impurities and nonmetallic inclusions in the produced alloy. A gas or gases produced in the electrowinning cell 2 in the course of the electrolytic reduction are introduced into an exhaust gas-treating means 18 together with the protection gas 16 for being placed under a predetermined treatment.

In the electrolysis system according to this invention, neodymium fluoride is used as the electrolysis raw material instead of the traditional neodymium oxide. Since the neodymium fluoride, being the raw material, is in this system a principal component of the electrolyte bath at the same time, supplementing the same in the bath as it is consumed in the course of electrolysis is relatively easy. Another merit of this neodymium fluoride, used as the raw material, resides in that it allows continuation of the electrolysis in far wider a range of raw material concentration in the bath compared with the oxide electrolysis. As to the way of supplementing the raw material, sprinkling powdery neodymium fluoride on the surface of the electrolyte bath is quite common and preferable because of its easier dissolution into the bath. It is, however, allowable to introduce it into the bath together with a gas, or to immerse a compressed powder briquette. Another advantage of the use of the neodymium fluoride superior to neodymium oxide as the raw material is far wider a range of allowance in the electrolytic raw material concentration observed within the interpolar electrolysis region in the bath. Continuation of the electrolytic operation, being provided with a wider allowance range in the raw material concentration in the bath, is not affected so much by a delay of raw material feed to this interpolar region. In comparison with the traditional operation using neodymium oxide, the invented method using the neodymium fluoride, with far wider a region of allowance in regard to its concentration, is relieved to a large extent from restrictions on the raw material supply position and on the raw material supply rate depending on the current applied.

In the manufacturing of the neodymium-iron alloy, according to this invention, of low content of impurities and of non-metallic inclusions, it is required to maintain the electrolysis temperature as low as practicable. For this purpose, a mixture of molten salts consisting substantially of 35–76% by weight of neodymium fluoride, 20–60% by weight of lithium fluoride, 0–40% by weight of barium fluoride and 0–20% by weight of calcium fluoride (total of the neodymium fluoride, the lithium fluoride, the barium fluoride and the calcium fluoride amounts to substantially 100%) is selected as the electrolyte bath. Even when the raw material of neodymium fluoride is added thereto, the electrolyte bath must be adjusted so as to maintain during the entire process of electrolysis the above-mentioned composition.

In regard to the composition of the components of the electrolyte bath, lowering of the neodymium fluoride concentration below the lowest limit, i.e, less than 35% will deteriorate the electrolysis results, and raising beyond the highest limit, i.e., higher than 76% will problematically increase the melting point of the bath. As to the concentration of lithium fluoride, excessive lowering thereof will raise the melting point of the bath, and excessive raising thereof will make the mutual interaction between the produced alloy and the bath too vigorous, resulting from deterioration of the electrolysis results. The concentration thereof must therefore be adjusted in the range of 20–60%.

Adding the barium fluoride and/or the calcium fluoride is aimed at decreasing the amount of use of the expensive lithium fluoride and also aimed at the adjustment of the melting point of the mixed electrolyte bath. Excessive addition of them tends to raise the melting point of the bath, so the concentration of the former must be limited up to 40% and that of the latter to 20%, although they may be used either alone or jointly. In any way the electrolyte bath must always be so composed of as to make the sum of the four components, i.e., neodymium fluoride, lithium fluoride, barium fluoride and calcium fluoride to be substantially 100%. It is preferable again, when the electrolyte bath is composed only of neodymium fluoride and lithium fluoride, to adjust the concentration of the former to more than 40% and that of the latter more than 24%.

Each of the four components or constituents of the electrolyte bath needs not necessarily to be of high purity, unless they contain such impurities as to affect the electrolysis and the quality of the final products, such as magnetic properties of the permanent magnet. The presence of impurities, inevitably included in the ordinary industrial materials, are tolerable in the electrolyte bath, so far as the impurities are allowable to the final uses. The composition of the electrolyte bath must be selected, so that the specific gravity of the bath may be much smaller than that of the produced neodymium-iron alloy. The alloy produced on the cathode can drip off the cathode into the alloy receiver with an opening, located below the cathode because of this difference of the specific gravity between the two.

The temperature of the electrolyte bath having such a composition is preferably adjusted during the electrolysis operation between 770° C. and 950° C. At an excessively high temperature, impurities and foreign matter can enter into the products beyond the allowable limit; at an excessively low temperature, it is difficult to keep the bath composition uniform, with a result of deteriorating the nature of the bath so as to finally hinder continuation of the electrolysis.

Within above-mentioned temperature limits, a neodymium-iron alloy of high content, more than 73%, of neodymium can be advantageously manufactured, and the produced alloy forms liquid metal in the receiver. This molten alloy can be effectively siphoned or withdrawn from the electrowinning cell by vacuum suction. It is also possible to tap it from the bottom of the cell by flowing-down by gravity. In either way of the withdrawing of the alloy, it needs not to be heated at all, because it can be withdrawn easily in the liquid state as it is.

As to the electrodes used in the electrolysis in this invention, it is preferable to use iron for the cathode and to use carbon, in particular, graphite for the anode. Iron for the cathode must be of low content of impurities, such as oxygen, because such impurities tend to deteriorate the magnetic properties when the alloy is finally used for the permanent magnet. According to this invention, the iron cathode is consumed during the electrolysis operation so as to form the alloy. Compensation for the consumption of the cathode by means of gradual immersion of the same into the electrolyte bath will, however, enable to continue, without interruption, the electrolysis, i.e., manufacturing of the alloy. In this case, the iron material as the cathode may be connected one after another by forming threading on both ends, which makes it easy to continuously compensate for the consumption of the cathode. Use of such a solid iron cathode is, in comparison to a molten metal cathode, is far more convenient in its handling and is advantageous for simplifying the structure of the electrowinning cell. It naturally allows enlarging of the electrowinning cell, to a great advantage, in the case of industrialization.

In the electrolysis of neodymium fluoride using carbon anodes according to this invention, it is desirable to maintain the current density over the entire immersion surface of the anodes within the range of 0.05–0.60 $A/cm^2$ during all the time of the electrolysis operation. When the current density is excessively small, it means either that the immersion surface of the anode is too large or that the current per unit area of the anode surface is too small, which deteriorates the productivity, with a result of industrial demerit. On the other hand, raising the current density to too high a level tends to bring about the anode effect which has been observed in electrolysis using neodymium oxide as its raw material, or some other similar abnormal phenomena. It is therefore recommendable in the invention to maintain the anode current density within the above-mentioned range, as one of the required conditions for the electrolysis, so as to effectively prevent occurrence of such unusual phenomena. It is particularly more preferable to maintain the current density between 0.10 $A/cm^2$ and 0.40 $A/cm^2$ over the entire immersion surface of the anodes, from the consideration of possible variation of the current density on a local area thereof.

As to the current density on the cathode, a fairly broad range such as 0.50–55 $A/cm^2$ is allowed over the entire immersion surface thereof. When the current density on the cathode is too low, however, the current per unit surface area of the cathode becomes too small, thereby deteriorating the productivity to the extent of being industrially impractical; when it excessively rises, on the contrary, electrolytic voltage rises so much so as to deteriorate the electrolysis results. In the actual electrolysis operation in the production line, it is preferable to maintain the cathode current density in a somewhat narrower range, 1.5–25 $A/cm^2$, which facilitates maintaining the voltage fluctuation to be small and makes the electrolysis operation easy and smooth.

Regarding the electrodes, the anode is in this invention provided as a carbon anode independently, not letting the bath container or crucible, which is made of a material resistant to the corrosive action of the bath, function simultaneously as the anode, so consumption of the anode does not necessarily require stoppage or interruption of the operation as in the case of the crucible anode. A separately provided anode may be compensated for its consumption thereof by immersing the same deeper into the bath as it shortens. When the anode is provided in plurality, they can be replaced one by one as they shorten. As to the cathode, consumption can be compensated for similarly in this invention only by the deeper immersion of the same or by the replacement thereof. As to the arrangement or configuration of both electrodes, it is preferable in this invention, to set a plurality of anodes around each cathode so that the former can face the latter, taking advantage of the fairly large difference of the current density between anodes and cathodes. In that case, replacement of the anodes is an easy task, allowing for their successive replacement and thereby not interrupting the alloy-producing operation. The benefits of the electrolysis process can be herewith fully realized. It is also practically very convenient that both the anodes and cathodes have their constant and uniform shapes in their longitudinal direction, which facilitates their continuous and successive use, by being replaced in turn.

An electrowinning cell according to this invention will be described in detail with reference to a preferable embodiment illustrated in FIG. 2, which is in schematic sectional view.

The cell which is allotted the reference numeral 20 is composed of a lower main cell 22 and a lid body 24 covering the opening of the former. The outer sides of these two members 22 and 24 are usually covered by metallic outer shells 26, 28 respectively. Both the lower main cell 22 and the lid body 24 are respectively provided, inside the outer shells (26 and 28), with double lining layers laid one on the other, the outer being a refractory heat-insulating layer (30, 32) made of brick or castable alumina, etc., and the inner being a layer (34, 36) which is resistant to the attack of the bath and is made of graphite, a carbonaceous stamping mass, or the like.

The inner side of the corrosion-resistant material layer 34 is further provided with a lining member 38 for covering the potentially bath-contacting surface thereof. The lining member 38 functions to prevent entering of amounts of impurities coming from the corrosion-resistant layer 34, and when it is made of a refractory metal such as tungsten, molybdenum, etc., it can work at the same time as the earlier memtioned receiver for the dipping alloy. However, it is recommended in this invention to use an inexpensive iron material for the lining member 38. Studies of involving the inventors resulted in a discovery that the inexpensive iron has unexpected excellent corrosion resistance to the action of the electrolyte bath, i.e., fused fluoride salts, and that it can be a suitable lining member in the case of electrolyte bath of fluorides. It is permissible to omit the layer 34, since the lining member 38 can be directly applied on the refractory heat-insulating layer 30.

Passing through the lid body 24, one or a plurality of iron cathodes 40 and a plurality of carbon anodes 42, arranged to face each cathode 40, are set such that both (40, 42) may be immersed into the electrolyte bath of predetermined molten salts contained in the lower main cell 22 by the length or distance appropriate to produce a predetermined current density on each of the electrodes. The only two carbon anodes 42, 42, which should be arranged to face the iron cathode 40, are illustrated in the drawing. As the material for the anodes, graphite is recommendable.

Those carbon anodes 42 may be used in a variety of shapes, such as a rod form, a plate form, a pipe form, etc. They may also be fluted, as be well known, with the object of lowering the anode current density by enlarging the anode surface area of the immersed portion thereof in an electrolyte bath 44. The carbon anodes 42 in FIG. 2 are slightly tapered on the immersed portion thereof in order to show traces of the anode consumption. Those anodes 42 may be provided with a suitable electric lead-bar of metal or a like conductive material for the purpose of power supplying. They are also equipped with an ascent-and-descent device 46, with which they can be moved up and down into the bath and also adjusted continuously or intermittently as to the length of the immersed portion thereof so as to surely maintain the required anode current density. In other words, the surface area of the immersed portion, on which the anode current density under a constant current depends, is adjusted through the length thereof. The ascent-and-descent device 46 may be imparted the function, at the same time, as an electric contact.

The cathode or cathodes 40 are, on the other hand, made of iron, which is to be alloyed with the metallic neodymium in the electrolyte bath through the electrolytic reduction. In FIG. 2 only one cathode 40 is illustrated, and its immersed portion is shown in a cone, which means a sign of the cathode consumption due to dripping of the produced alloy of neodymium-iron. The cathode 40 takes a solid form, as the electrolysis temperature is selected below the melting point of the iron cathode 40, and may be a wire, a rod, or a plate in shape. This cathode 40 is also equipped with an ascent-and-descent device 48, with which it is introduced into the bath 44 continuously or intermittently so as to compensate the consumption thereof due to the alloy formation. The ascent-and-descent device 48 can simultaneously work as an electric contact. It is permissible to protect the non-immersed portion thereof with a sleeve or the like from corrosion.

For the purpose of reserving the alloy thus produced on the tip of the cathode 40, a receiver 50 is placed, in the bath 44, on the bottom of the lower main cell 22, with an opening or mouth thereof just below the cathode 40. A drop-formed liquid neodymium-iron alloy 52, produced on the tip of the cathode 40 by the electrolytic reduction, drips off the cathode 40 and falls down to be collected in the receiver 50. This receiver 50 may be made of a refractory metal such as tungsten, tantalum, molybdenum, niobium, or their alloys with small reactivity to the produced alloy 52. As its material, ceramics made of borides like boron nitride or of oxides or cermet are also permissible.

The electrolyte bath 44 is a fused salt solution of a fluoride mixture containing neodymium fluoride therein with an adjusted composition according to this invention, and its composition is selected so as to make the specific gravity thereof to be smaller than that of the produced neodymium-iron alloy. The electrolysis raw material which is consumed through electrolytic operation is supplemented by feeding it from a raw material-supply means 54 through a material supplying-hole 56 formed in the lid body 24 so as to prepare and maintain the electrolyte bath 44 of a predetermined preferable composition.

As mentioned earlier the produced alloy 52, which drips off the iron cathode 40 to be reserved in the receiver 50, is, when the reserved amount reaches to a certain predetermined value, withdrawn in a liquid state from the electrowinning cell 20 by a predetermined alloy siphoning or tapping system. In this invention an alloy-siphoning system, such as that illustrated in FIG. 2, is preferably used for this purpose, wherein a pipe-like vacuum suction nozzle 58 is inserted, through a produced alloy suction hole 60 formed in the lid body 24, into the electrolyte bath 44, such that the lower end of the nozzle 58 can be immersed into the produced alloy 52 in the alloy receiver 50, and the alloy 52 is withdrawn, through a sucking action of a not illustrated vacuum means, from the electrowinning cell 20.

It is also permissible to install an alloy tapping or flowing-out system, in place of the alloy siphoning system for withdrawing the alloy 52 by evacuation, which is provided with a tapping pipe, passing through the wall of the electrowinning cell 20 (lower main cell 22) and further passing through the wall of the alloy receiver 50, for having its opening in the alloy receiver 50, so as to flow the alloy 52 out of the lower main cell 22 by gravity.

There is a not illustrated a protection gas-supplying device, in this invention for supplying protetion gas into the cell 20 such that possibly generated gas or gases in the course of electrolysis operation may be discharged together with the protection gas through an exhaust gas outlet port 62. It goes without saying that a heating device may be equipped, when needed, inside or outside the cell 20 for maintaining the electrolysis temperature to a desired level, although it is not attached in this embodiment.

Figure 3:
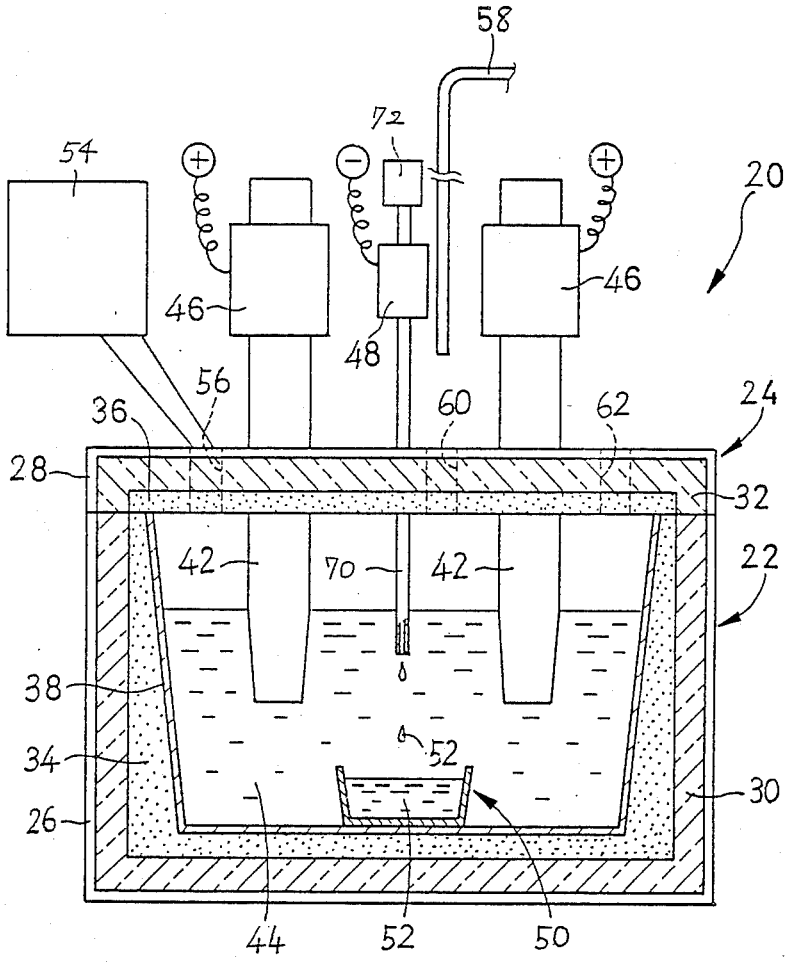
FIG. 3 is a view similar to FIG. 2, showing another embodiment of the electrowinning cell of the invention.

FIG. 3 shows the second embodiment of the electrowinning cell according to the invention. The electrowinning cell of FIG. 3 is equipped with an iron cathode or cathodes 70 in a form of elongate tubular members. Only one cathode is illustrated in the drawing.

The cathode 70 is made of a pipe-like or a tubular member of iron which is to be alloyed with the deposited neodymium through electrolytic reduction, and is continuously or intermittently fed or introduced into the electrolyte bath 44, by means of a cathode ascent-and-descent or positioning means 48 as a cathode-feeding or introducing means, so as to compensate for the consumption thereof due to the production of alloy. The cathode positioning means 48 functions at the same time as an electric contact to the cathode 70. The cathode 70 is permissible to be protected from corrosion, at the non-immersed portion thereof, with a suitable protective sleeve or the like.

The pipe-like iron cathode 70 of this type is, at an upper end thereof outside the cell 20, connected to a protection gas-supplying means 72. So the atmosphere in the hollow interior space of the iron cathode 70 is filled with a protection gas, i.e., an inert gas like rare gas having a positive pressure.

On the bottom of the lower main cell 22 containing the electrolyte bath 44, an alloy receiver 50 is placed, with its opening or mouth located just below the pipe-like cathode 70. Through applying a predetermined direct current between the cathode 70 and the anodes 42, a liquid neodymium-iron alloy is produced on the iron cathode 70, due to the electrolytic reduction of the neodymium fluoride as the raw material, and it drips one drop at a time for being reserved as a molten pool in the alloy receiver 50 having its opening below the iron cathode 70.

When the alloy 52 is produced on the surface of the iron cathode 70, the iron cathode 70 itself is consumed gradually as the electrolysis progresses. In this embodiment, however, wherein the iron cathode 70 is of pipe-like shape, the cathode is consumed first by decreasing its wall thickness and then by gradually decreasing its length, unlike too-thick-a-rod shape cathode which may become slender by consumption but remain long enough, even if the diameter of the rod is same as that of the pipe, so as to finally contact the surface of the molten pool 52 or the receiver 50. This is a good point of the pipe-like iron cathode with the same diameter in comparison with the rod shape iron cathode which is subjected to the above-mentioned problem.

In a case where a plurality of large diameter carbon anodes 42 are arranged around a cathode or each cathode so as to face it, a large diameter cathode or cathodes can be employed, by selecting a pipe-like shape for the cathode or cathodes, wherein the merits of trouble-free consumption of the same described above are enjoyable. Adoption of the large diameter pipe-like cathodes brings about various advantages, for example: effective prevention of a rise of the bath drop and electrolytic cell voltage caused by too much an increase of the interpolar distance; prevention of an increase of the specific power consumption; and prevention of a large variation (particularly rising one) of the temperature in the electrolyte bath, etc.

The outer diameter of the iron cathode 70 can be, in accordance with the diameter of the employed carbon anodes 42, suitably selected in a wide range so as to be able to produce a desired cathode current density, i.e., 0.50–55 $A/cm^2$. Even when a large outer diameter is selected for the pipe-like cathode, a continuous electrolysis operation can be effeted, while preventing various problems stated above, by means of selecting a suitable wall thickness of the pipe-like cathode for being consumed. Besides, the iron cathode 70 of elongated hollow pipe can be of various shapes in its cross section, to say nothing of the usual shape of circular, such as eliptic, triangular, quadrangular, pentagonal, hexagonal, octagonal, some other polygonal, rhombic, rectangular, star-shaped, etc. As to the configuration or arrangement of the electrodes, a variety of types can be selected, as a matter of course, on conditions that the current densities are maintained in predetermined ranges and the each cathode 70 and the anodes 42 are placed face to face, besides the exemplified arrangement wherein a plurality of anodes 42 are placed concentrically around the cathode 70 standing in the center.

The raw material to be consumed in the electrolytic operation carried out in such an electrolysis apparatus is supplied from a material-supply means 54, through a material-supplying hole 56 formed in the lid body 24, so as to form an electrolyte bath with a predetermined composition in the cell. The produced alloy 52 collected in the receiver 50 is, when it has reached a predetermined amount, withdrawn from the electrowinning cell 20 in a liquid state by means of a predetermined alloy-recovering system (siphoning means), which is provided with, for example, a pipe-like vacuum suction nozzle 58 which is inserted through an alloy suction hole 60 into the electrolyte bath 44 and immersed with the tip thereof in the molten pool of the alloy 52 in the receiver 50 for sucking the alloy 52 by an evacuating action of a not-illustrated vacuum device. As mentioned earlier protection gas is introduced into the electrowinning cell 20 for the purpose of protecting the bath 44, the alloy 52, each cathode 70, the anodes 42, and the structural material of the cell 20 itself from deteriorating and also from preventing the pickup of impurities as well as foreign matter into the produced alloy 52. Possibly produced gas or gases in the course of electrolysis can be discharged together with the protection gas, which has been introduced in such a manner, outside through an exhaust gas outlet 62.

The material-supply device (54, 56), the alloy-withdrawing device (58, 60) and the protection gas device, etc., are each in the above description a separately or independently disposed one from the electrowinning cell 20. It is possible, however, to utilize the internal hollow space of the iron cathode 70, when it is made into a pipe-like shape, as the passage for the protection gas, for the neodymium fluoride as the electrolytic raw material, or for the alloy suction nozzle.

If the protection gas is introduced, as earlier exemplified, from the protection gas-supplying means 72 connected to the outer opening of the iron cathode 70 into the internal hollow space of the iron cathode 70 under a positive pressure, it can contribute to prevent the inner surface of the iron cathode 70 from corrosion due to the atmospheric air which would otherwise occupy the hollow space, and also to effectively insulate the same from an electric current flow, with a lower current density than expected due to the electrolyte bath 44 which would otherwise occupy there and let the current flow.

If the protection gas introduced from the protection gas-supplying means 72 into the iron cathode 70 is increased in its amount as to be blown into the electrolyte bath 44 through an opening at the lower end of the cathode 70, it will help promote the dissolution of the neodymium fluoride raw material into the bath 44 through its stirring action of the bath 44, and filling the upper semi-open space in the cell above the bath 44 with the protection gas.

In parallel with flowing the protetion gas from the protection-gas supplying means 72, powdered neodymium fluoride raw material can be supplied through the interior hollow space of the iron cathode 70 into the electrolyte bath 44. It enables to effect parallelly the raw material supplying into the bath and the promotion of raw material dissolution into the bath. It can also advantageously let the formation of the raw material-supplying hole 56 in the lid body 24 be omissible. Incidentally, the neodymium fluoride raw material can be supplied into the bath 44 not only in the form of powder but also in a solid form with a certain shape, and in such a case it can be sent into the bath 44 by passing through the hollow space within the pipe-like iron cathode 70.

The internal hollow space of the iron cathode 70 can be as earlier mentioned used as a passage of the protection gas, but it is also permissible to pass a separately made protection gas pipe through the hollow space, i.e., as a duplex pipe.

When the produced alloy 52, after having reached a predetermined amount, is withdrawn from the receiver 50 outside the cell 20 by means of the vacuum suction type nozzle 58, it is also possible to use the internal hollow space of the iron cathode 70 as a nozzle-inserting hole instead of the alloy siphoning hole 60. In other words, the vertical part of the nozzle 58 is inserted through the internal hollow space of the cathode 70 into the molten pool of the alloy 52 collected in the receiver 50, placed at the bottom of the electrolyte bath 44, for siphoning it out from the cell 20.

Some of alloy-making examples will be disclosed hereunder. It must be understood that this invention is in no sense restricted by such examples.

The present invention can be practiced in a variety of ways other than the above-mentioned description and the disclosed embodiments as well as the following examples, based on the knowledge of those skilled in the art, within the limit and spirit thereof. All of those varieties and modifications should be understood to be included in this invention.

EXAMPLE 1

A neodymium-iron alloy (Nd-Fe), 11.3 kg, with an average composition of 80% by weight of neodymium and 18% by weight of iron was obtained by the following process.

Figure 2:
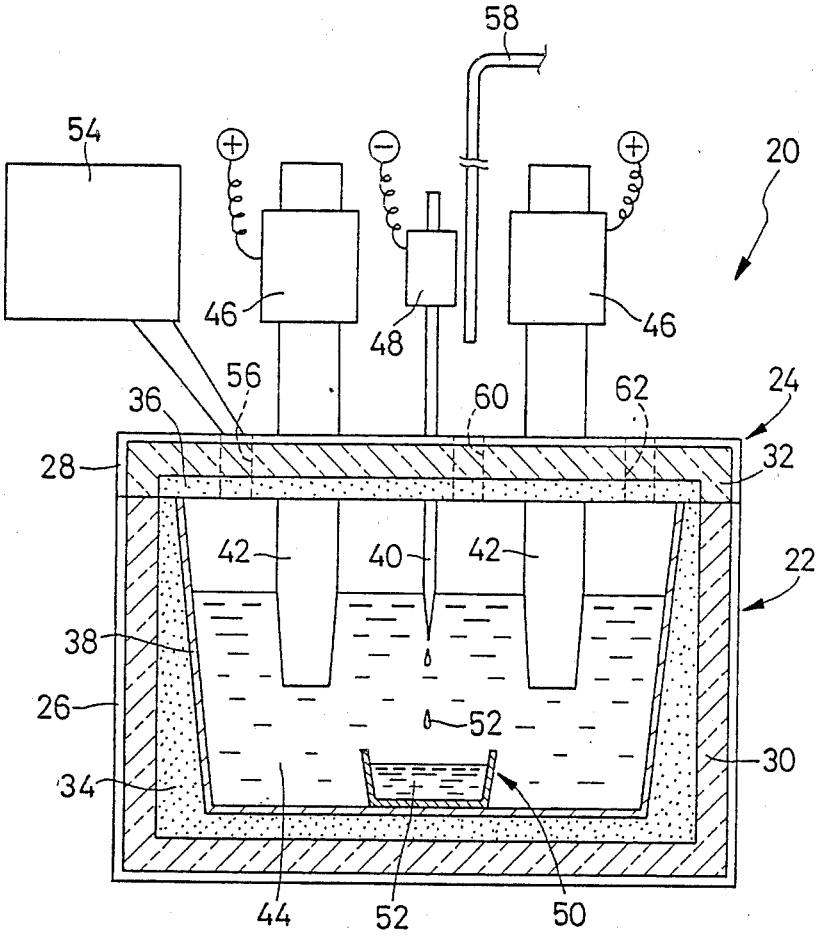
FIG. 2 is a sectional view for illustrating a structure of an example of the electrowinning cell, with which the present invention is realized.

An electrolyte bath made of two fluorides, i.e., neodymium fluoride and lithium fluoride was electrolyzed in an inert gas atmosphere with an electrowinning cell of the type shown in FIG. 2, wherein as the cell material resistant to the bath, a graphite crucible was used; an alloy receiver of molybdenum was placed in the middle portion of the bottom of the graphite crucible; six of wire-like vertical iron cathodes with 6 mm$\phi$ were so immersed in the bath in the middle portion of the graphite crucible so as to be arranged concentrically (in the plan view); and six of rod-like vertical anodes with 80 mm$\phi$ of graphite were immersed in the bath in a concentrical (in the plan view) arrangement around the cathodes.

A powdered neodymium fluoride raw material was continuously supplied so as to maintain the electrolysis operation for 24 hours under the operating conditions shown in Table I. All the time during this operation, the electrolysis was satisfactorily continued, wherein produced liquid neodymium-iron alloy dripped one drop at a time and was collected in the molybdenum receiver placed in the bath. The alloy was siphoned from the cell once every eight hours with a vacuum suction type alloy siphoning system having a nozzle.

The electrolysis results and the analysis results of the obtained alloy are shown in Table I and Table II, respectively.

For the purpose of comparison, another electrolysis was executed in a similar cell and under substantially similar conditions, wherein powdered neodymium oxide as a raw material was continuously supplied to an electrolysis area between the cathodes and the anodes where anode gases were evolved. In this experiment, sludge of the neodymium oxide was remarkably accumulated on the bottom of the cell as the electrolysis progressed. Anode effect took place often. Trials for preventing the occurence of the anode effect by lowering the anode current density were unsatisfactory. Raising the bath temperature as one of countermeasures to prevent the anode effect increased the amount of impurities and non-metallic inclusions entered in the produced alloys, irrespective of an expected slight improvement in the operational aspects.

EXAMPLE 2

A neodymium-iron alloy, 20.9 kg, with an average composition, 88% by weight of neodymium and 10% by weight of iron was obtained by way of the undermentioned electrolysis operation, but at lower temperatures than in Example 1.

A lining of iron was applied inside a container of graphite crucible in the cell and the alloy receiver was made of tungsten. A mixture of neodymium fluoride, lithium fluoride, and barium fluoride as the electrolyte bath was electrolyzed in an inert gas atmosphere. Three of iron rod-like vertical cathodes with 12 mmϕ were arranged in the similar manner as in Example 1. Six vertical anodes with 80 mmϕ were used just like in Example 1.

The raw material of neodymium fluoride was intermittently supplied into the bath during the continuous electrolysis operation of 48 hours under the conditions in Table I. The process progressed satisfactorily, and the produced neodymium-iron alloy was reserved in the tungsten receiver, having dripped thereinto one drop after another during the operation. The alloy could be siphoned in a liquid state as in Example 1.

The electrolysis results and the analysis results of the produced alloy are shown respectively in Table I and Table II.

For the purpose of comparison, a like experiment to that in Example 1 was conducted, wherein neodymium oxide was used as the raw material. Both accumulation of the sludge of neodymium oxide and occurrence of the anode effect became from bad to worse as the electrolysis progressed, and finally the operation had to be interrupted.

EXAMPLE 3

A neodymium-iron alloy, 6.6 kg, having an average composition, 84% by weight of neodymium and 14% by weight of iron, was obtained in the undermentioned electrolysis operation executed at lower temperatures than that in Example 1.

The electrolysis was executed in a container of an iron crucible, resistant to the bath attack and disposed in the cell, in the center of the bottom of the crucible a like alloy receiver to that in Example 1 being placed. An electrolyte bath of a mixture substantially composed of two fluorides, i.e., neodymium fluoride and lithium fluoride, was electrolyzed in an inert gas atmosphere; employed cathodes were three vertical iron rods with 12 mmϕ, similar to those in Example 2, and anodes were five vertical graphite rods with 60 mmϕ which were concentrically (in the plan view) arranged around the cathodes.

Under the operation conditions shown in Table I, the electrolysis was continued 24 hours without any problems, being continuously supplied with neodymium fluoride as the raw material. The produced alloy of neodymium-iron dripped off the cathodes and was collected in the receiver of molybdenum. This alloy was siphoned from the cell in a liquid state to the similar manner taken in Example 1.

The electrolysis results as well as the analysis results of the produced alloy are shown respectively in Table I and Table II.

In this example of electrolysis operation, the upper limit of the cathode current density was restricted to maintain the current density within a narrowly limited range, which contributed to an improvement of the voltage fluctuation range through the prevention of voltage rising during the electrolysis.

EXAMPLE 4

A neodymium-iron alloy, 4.6 kg, with an average composition, 90% by weight of neodymium and 8% by weight of iron was obtained in the following electrolysis operation, under further lower temperatures than that in Examples 2 and 3.

As a container resistant to the bath, an iron crucible was employed as in Example 3, and in the center portion of the bottom of the crucible, an alloy receiver similar to that in Example 2 was placed. The electrolyte bath substantially composed of two fluorides, i.e., neodymium fluoride and lithium fluoride, was electrolyzed in an inert gas atmosphere. Only one cathode of vertical iron rod with 34 mmϕ and five of vertical graphite rod anodes with 60 mmϕ like in Example 3, were employed.

The electrolysis was carried out under the conditions, shown in Table I, which were maintained during the operation. It was continued for 18 hours with continuous feed of neodymium fluoride raw material. A liquid alloy of neodymium-iron dropped into the alloy receiver of tungsten. The collected alloy was siphoned from the cell once every eight hours by means of a vacuum suction type alloy siphoning system having a nozzle shown in FIG. 2. The nozzle was heated before being inserted into the electrowinning cell.

The electrolysis results as well as the analysis results of the produced alloy are shown respectively in Table I and Table II.

TABLE I

| | | Example 1 | Example 2 | Example 3 | Example 4 |
|---|---|---|---|---|---|
| | Current (A) | 300 | 300 | 200 | 200 |
| | Time (hr) | 24 | 48 | 24 | 16 |
| Conditions for Electrolysis | | | | | |
| Compositions of | Neodymium Fluoride (%) | 41–76 | 35–59 | 59–69 | 66–70 |
| Electrolyte | Lithium Fluoride (%) | 24–59 | 25–43 | 31–41 | 30–34 |
| Bath | Barium Fluoride (%) | 0 | 14–26 | 0 | 0 |
| Temperature (°C.) | | 910–950 | 816–852 | 820–866 | 774–801 |
| Anode Current Density (A/cm$^2$) | | 0.23–0.60 | 0.17–0.38 | 0.13–0.28 | 0.14–0.25 |

TABLE I-continued

| | | Example 1 | Example 2 | Example 3 | Example 4 |
|---|---|---|---|---|---|
| Cathode Current Density (A/cm$^2$) | | 2.9–51 | 2.9–53 | 2.1–5.2 | 2.0–3.6 |
| Electrolysis Results | | | | | |
| Voltage (V) | | 8.0–11.1 | 7.3–11.8 | 6.8–8.0 | 6.6–11.2 |
| Current Efficiency (%) | | 70 | 71 | 64 | 72 |
| Produced | Weight (kg) | 11.3 | 20.9 | 6.6 | 4.6 |
| Neodymium-iron alloy | Neodymium (%) | 76–81 | 87–90 | 83–85 | 89–91 |

TABLE II

| | Major components | | Impurities | | | | | | |
|---|---|---|---|---|---|---|---|---|---|
| Samples | Nd (%) | Fe (%) | Ca (%) | Mg (%) | Al (%) | W/Mo (%) | C (%) | O (%) | Non-metallic inclusions |
| Example 1 | 80 | 18 | <0.01 | 0.02 | 0.05 | Mo = 0.02 | 0.08 | 0.03 | slight |
| Example 2 | 88 | 10 | <0.01 | 0.01 | 0.03 | W < 0.005 | 0.06 | 0.02 | slight |
| Example 3 | 84 | 14 | <0.01 | <0.01 | 0.03 | Mo = 0.02 | 0.05 | 0.02 | slight |
| Example 4 | 90 | 8 | <0.01 | 0.01 | 0.03 | W < 0.005 | 0.05 | 0.02 | slight |
| Reference 1 (goods on the market) | 97 | impurities <0.1 | 0.51 | 0.39 | 0.75 | — | 0.15 | 0.54 | substantial |
| Reference 2 (goods on the market) | 98 | impurities <0.1 | 0.15 | 0.06 | 0.36 | — | 0.12 | 0.35 | substantial |

In this invention, as can be evidently observed in Table I and Table II, neodymium-iron alloys rich in neodymium can be produced easily and in only one step. It is also clearly recognized in these Tables, that the produced neodymium-iron alloys in the invented method contain little impurities, such as oxygen, which are known to have a detrimental effect on magnetic properties. The numerical figures of the compositions shown in Table II were the averages of the analysis values of the alloys which were recovered at the end of each eight-hour interval, respectively. Impurities other than those shown in Table II are substantially other rare earth metals than neodymium. In Table II the analysis results of the neodymium metals on the market are further listed for the purpose of comparison. Those neodymium metals obtainable on the market are all of rather high content of impurities harmful to the magnetic material.

With regard to the first three examples 1–3 among the four, it is easy to continue the experiments longer exceeding the time durations shown in Table I, and similar results to those tabulated in the Tables have been ascertained even in the said elongated experiment.

EXAMPLE 5

A neodymium-iron alloy, 10.0 kg, was obtained, with an average composition of 89% by weight of neodymium and 9% by weight of iron, by the apparatus and process undermentioned.

In an electrowinning cell similar to one illustrated in FIG. 3, an iron crucible was used in the cell as a container resistant to the bath and an alloy receiver disposed at the central portion of the bottom thereof was made of molybdenum. An electrolyte bath of fused salts composed substantially of three fluorides, i.e., neodymium fluoride, lithium fluoride, and barium fluoride, was electrolyzed in an inert gas atmosphere. An iron pipe-like vertical cathode, with its top end being sealed, having an outer diameter of 34 mm and a wall thickness of 3 mm, was arranged so as to be positioned in the central portion of the iron crucible and to be immersed at the lower portion thereof in the electrolyte bath. Six vertical anodes made of a graphite rod with a diameter of 80 mm were concentrically arranged around the cathode so as to be immersed at the lower portion thereof in the electrolyte bath.

The electrolysis was continuously conducted, using neodymium fluoride as the feed material, for 24 hours while the electrolytic conditions shown in Table III were maintained. During this experiment the electrolysis operation progressed smoothly, and the neodymium-iron alloy produced in a liquid state dripped one drop after another into the molybdenum, and the reserved alloy therein was siphoned from the cell once every 8 hours by a vacuum suction type alloy-recovering means having a nozzle. Electrolysis results and analysis results of the produced alloys are shown in Table III and Table IV, respectively.

EXAMPLE 6

A neodymium-iron alloy, 6.7 kg, was obtained with an average composition of 85% by weight of neodymium and 13% by weight of iron, by the apparatus and process undermentioned.

As a container for the electrolyte bath, the container having an iron lining over the inside surface of the graphite crucible was used, and an alloy receiver placed in the central portion of the bottom of the container was made of tungsten. An electrolyte bath of fused salts composed substantially of two fluorides, i.e., neodymium fluoride, and lithium fluoride was electrolyzed in an inert gas atmosphere. An iron pipe-like vertical cathode similar to that in Example 5, with an outer diameter of 34 mm and a wall thickness 3 mm, was used. Five of vertical anodes made of graphite rods with a diameter of 60 mm were similarly arranged as in Example 5. On the top of the pipe-like cathode, a protecting gas-introducing cap was attached such that the protection gas might be slowly introduced into the bath during the electrolysis operation.

The electrolysis was continued, with powdered neodymium fluoride as the raw material, being continuously supplied into the bath, for 24 hours under the electrolytic conditions shown in Table III. The electrolysis progressed very smoothly and satisfactorily, so that the produced neodymium-iron alloy dripped gradually into the receiver of tungsten so as to be collected therein. The reserved alloy was siphoned from the cell once every 8 hours by a vacuum suction type alloy-recovering means having a nozzle. Electrolysis results and analysis results of the produced alloys are shown in Table III and Table IV, respectively.

EXAMPLE 7

Electrolysis was conducted, with a similar apparatus as in Example 5 by using the electrolyte bath of a mixture of fused salts composed substantially of two fluorides, i.e., neodymium fluoride and lithium fluoride in an inert gas atmosphere.

As the cathode, a vertical iron pipe with an outer diameter of 110 mm and a wall thickness of 14 mm was used so as to be immersed at its lower end into the bath, and as the anodes, eight vertical graphite rods with a diameter of 80 mm were concentrically arranged around the cathode so as to be immersed at the tip portion thereof in the electrolyte bath.

A powdered neodymium fluoride as the raw material was press-formed into a number of cube-form solid bodies and put into an iron basket, so as to be immersed in the electrolyte bath. The basket was passed through the internal hollow space of the cathode, from the top opening through the lower end. The electrolysis was conducted 8 hours under the well maintained electrolytic conditions shown in Table III. At the top end of the cathode electric insulation and gas sealing was carried out during the electrolysis. The process was carried out satisfactorily and the produced alloy was recovered at the end of the electrolysis outside the cell by means of a vacuum-sucking type alloy-recovering means having a nozzle. The neodymium fluoride in the iron basket was found to be dissolved one hundred percent. Electrolysis results and analysis results of the produced alloys are shown in Table III and Table IV, respectively.

TABLE III

| | | Example 5 | Example 6 | Example 7 |
|---|---|---|---|---|
| | Current (A) | 300 | 200 | 400 |
| | Time (hr) | 24 | 24 | 8 |
| Conditions for Electrolysis | | | | |
| Compositions of Electrolyte Bath | Neodymium Fluoride (%) | 55–63 | 63–70 | 67–69 |
| | Lithium Fluoride (%) | 22–27 | 30–37 | 31–33 |
| | Barium Fluoride (%) | 13–17 | — | — |
| Temperature (°C.) | | 789–826 | 843–872 | 824–830 |
| Anode Current Density (A/cm$^2$) | | 0.12–0.15 | 0.20–0.28 | 0.18–0.24 |
| Cathode Current Density (A/cm$^2$) | | 1.5–6.3 | 2.0–7.1 | 2.3–4.6 |
| Electrolysis Results | | | | |
| Voltage (V) | | 6.8–9.2 | 7.2–9.3 | 7.1–7.5 |
| Current Efficiency (%) | | 69 | 66 | 70 |
| Produced Neodymium-iron alloy | Weight (kg) | 10.0 | 6.7 | 4.6 |
| | Neodymium (%) | 86–90 | 83–88 | 87 |

TABLE IV

| | Major components | | Impurities | | | | | | |
|---|---|---|---|---|---|---|---|---|---|
| Samples | Nd (%) | Fe (%) | Ca (%) | Mg (%) | Al (%) | W/Mo (%) | C (%) | O (%) | Non-metallic inclusions |
| Example 5 | 89 | 9 | <0.01 | 0.02 | 0.02 | Mo = 0.02 | 0.04 | 0.02 | slight |
| Example 6 | 85 | 13 | <0.01 | 0.01 | 0.03 | W < 0.005 | 0.06 | 0.02 | slight |
| Example 7 | 87 | 11 | <0.01 | <0.01 | 0.03 | Mo = 0.02 | 0.05 | 0.03 | slight |
| Reference 3 (goods on the market) | 97 | impurities <0.1 | 0.51 | 0.39 | 0.75 | — | 0.15 | 0.54 | substantial |
| Reference 4 (goods on the market) | 98 | impurities <0.1 | 0.15 | 0.06 | 0.36 | — | 0.12 | 0.35 | substantial |

According to this invention, as evidently observed in Table III and Table IV, neodymium-iron alloys richly containing neodymium are produced easily and in only one process. It is also clearly recognized in these Tables that the produced neodymium-iron alloys in the invented method contain little impurities, such as oxygen, known to be harmful to the magnetic properties. The values shown in Table IV are calculated as the averages of the analyzed values of the alloys which have been recovered at the end of each eight-hour interval. Impurities other than those shown in Table IV are substantially rare earth metals other than neodymium. In Table IV are further listed the analysis results of the neodymium metals on the market for the purpose of comparison. Those neodymium metals obtainable on the market are all of high content of impurities, for example, oxygen, which is harmful to the magnetic material.

With regard to the two examples 5–6, it is easy to continue the experiments longer exceeding the time durations shown in the Table III, and the similar results to those tabulated in the Tables can be obtained to.

What is claimed is:

1. A process for producing a neodymium-iron alloy comprising:

preparing a bath of molten electrolyte which has a composition consisting essentially of 35–76% by weight of neodymium fluoride, 20–60% by weight of lithium fluoride, up to 40% by weight of barium fluoride and up to 20% by weight of calcium fluoride, said molten bath being exposed to at least one iron cathode and at least one carbon anode, said bath being held at a temperature of 770°–950° C.;

effecting electrolytic reduction of said neodymium fluoride in said bath of molten electrolyte by applying a first direct current to said at least one carbon anode, said first direct current having a current density of 0.05–0.60 A/cm$^2$, and applying a second direct current to said at least one iron cathode, said second direct current having a current density of 0.5–55 A/cm$^2$, so as to electrodeposit neodymium on said at least one iron cathode and alloying the electrodeposited neodymium with iron from said at least one iron cathode, thereby producing a liquid neodymium-iron alloy on said at least one iron cathode;

continuously adding neodymium fluoride to said bath of molten electrolyte so as to maintain the composition of the bath, thereby compensating for consumption of the neodymium fluoride during production of said liquid neodymium-iron alloy dripping the liquid neodymium-iron alloy from said at least one iron cathode into a receiver having a mouth which is opened upward relative to said bath, said receiver being located in a lower portion of the bath of electrolyte below said at least one iron cathode, thereby collecting said liquid neodymium-iron alloy in the form of a molten pool in said receiver; and withdrawing said molten pool of the liquid neodymium-iron alloy from said receiver.

2. A process according to claim 1, wherein said at least one carbon anode is made of graphite.

3. A process according to claim 1, wherein said at least one iron cathode is an elongate solid member having a substantially constant transverse cross sectional shape over its length.

4. A process according to claim 1, wherein said at least one iron cathode is an elongate tubular member having a substantially constant transverse cross sectional shape over its length.

5. A process according to claim 1, wherein said bath of electrolyte containing said neodymium compound consists essentially of at least 40% by weight of neodymium fluoride and at least 24% by weight of lithium fluoride.

* * * * *